United States Patent [19]

Twiford

[11] 4,238,986

[45] Dec. 16, 1980

[54] METHOD FOR ALTERING TONAL CHARACTERISTICS OF A STRINGED MUSICAL INSTRUMENT

[76] Inventor: L. John Twiford, 4640 E. Lewis, Phoenix, Ariz. 85008

[21] Appl. No.: 15,852

[22] Filed: Feb. 27, 1979

Related U.S. Application Data

[63] Continuation-in-part of Ser. No. 831,236, Sep. 7, 1977, abandoned.

[51] Int. Cl.[3] ..... G10D 3/04

[52] U.S. Cl. ..... 84/309; 84/274

[58] Field of Search ..... 84/307–311

[56] References Cited

U.S. PATENT DOCUMENTS

| | | | |
|---|---|---|---|
| D. 28,956 | 6/1898 | Reel | 84/309 X |
| 1,438,386 | 12/1922 | Lucas | 84/309 X |
| 1,649,376 | 11/1927 | Bacon et al. | 84/308 |
| 3,494,239 | 2/1970 | Kasha | 84/309 X |

OTHER PUBLICATIONS

Giltay, J. W.: "Bow Instruments", Scholarly Press, Inc., St. Clair Shores, Michigan, 1976, pp. 18–39.

*Primary Examiner*—Lawrence R. Franklin
*Attorney, Agent, or Firm*—Drummond and Nelson

[57] ABSTRACT

The bridge has a pair of elongate feet forming the contact between the bridge and the table of the instrument. The feet extend at right angles to the bridge in direction substantially parallel to the grain of the wood from which the table is formed.

Methods utilizing an improved bridge for a stringed musical instrument for improving and/or altering the tonal qualities of stringed instruments.

1 Claim, 2 Drawing Figures

METHOD FOR ALTERING TONAL CHARACTERISTICS OF A STRINGED MUSICAL INSTRUMENT

This application is a continuation-in-part of my pending application, Ser. No. 831,236 filed Sept. 7, 1977, now abandoned.

This invention relates to methods of altering the tonal qualities of stringed musical instruments.

Typical stringed musical instruments have a bridge member which extends across and is supported by the "table" of the instrument.

The table of a stringed instrument typically consists of a thin sheet of wood, molded to form the proper curvature for the particular instrument, with the grain of the wood extending longitudinally from the rear toward the forward end of the instrument where the neck and fingerboard are attached.

The bridge maintains the strings of the instrument spaced above the fingerboard and the table and assists in maintaining the proper transverse spacing of the substantially parallel strings.

Prior art bridges for stringed instruments typically consist of an intermediate arch or support portion with integrally formed feet which rest upon the table of the instrument and the feet of the prior art bridges extend transversely of the grain of the wood forming the table.

The techniques involved in the manufacture of stringed instruments have reached a very high degree of refinement, and in fact, constitute a sophisticated art. The desired tonal qualities of the various stringed instruments have become more or less standardized and the degree to which these tonal standards are achieved by a particular stringed instrument profoundly affects the price at which the instrument is sold to the performer.

It would be highly desirable, however, to provide methods for altering the tonal qualities of a particular stringed instrument. Such alteration could enable one to rapidly and very inexpensively upgrade the tonal qualities of a less expensive instrument to more closely achieve the tonal qualities of a much more expensive instrument. Alternatively, specific tonal qualities of even a very expensive instrument could be altered to suit the performer's desires.

The object of the invention is to provide a method for obtaining the tonal qualities of a stringed musical instrument.

Still another object of the invention is to provide a method for conveniently and inexpensively altering the tonal qualities of a less expensive instrument to more closely approximate the tonal qualities of a much more expensive instrument.

Figure 1:
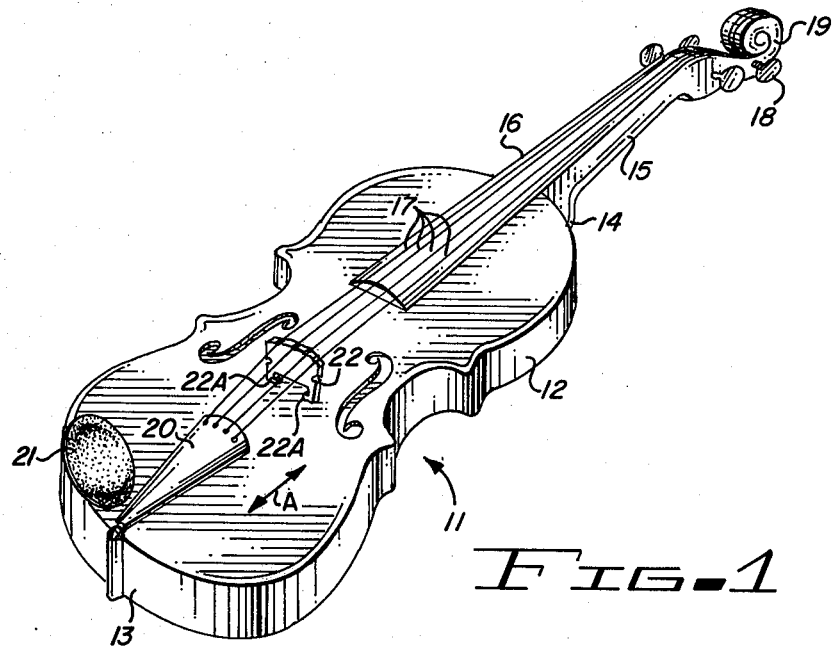
Figure 2:
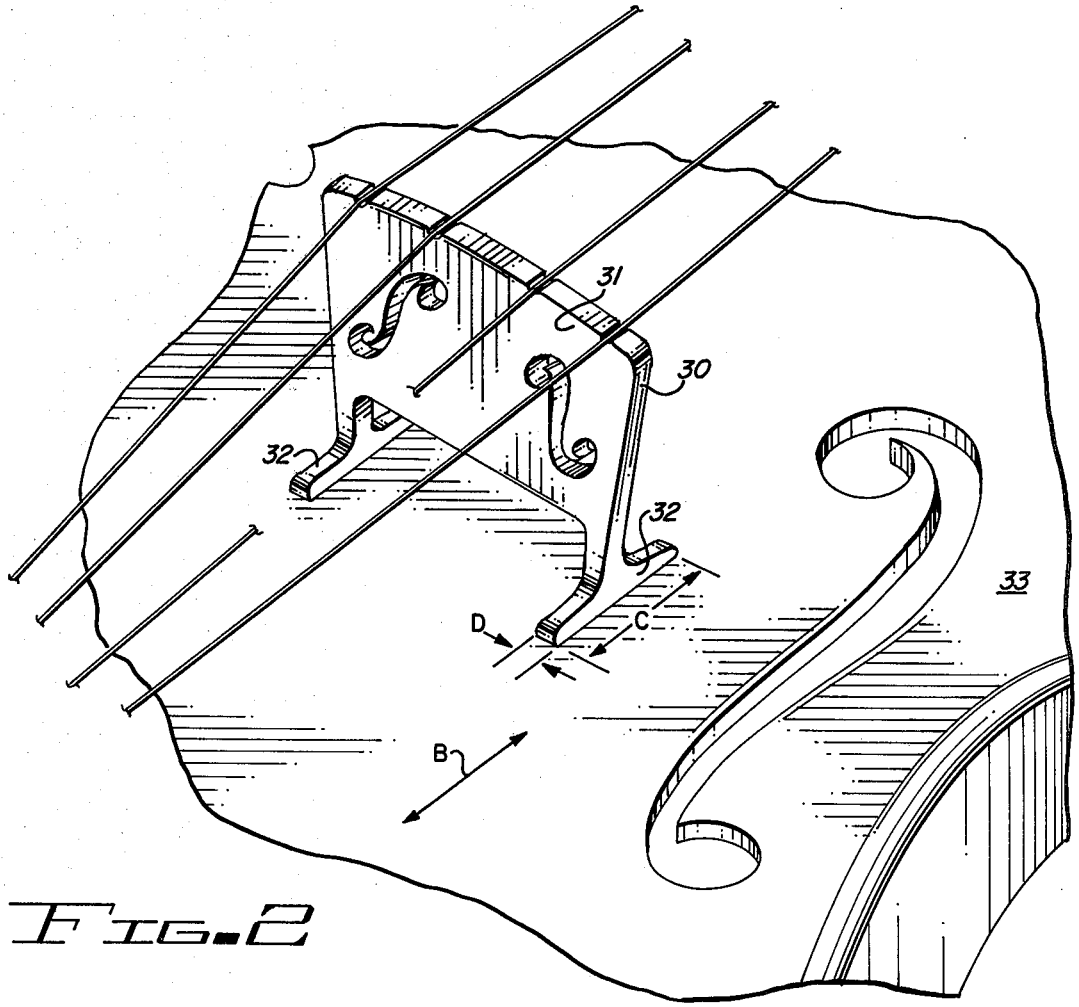

These and other, further and more specific objects and advantages of the invention will be apparent to those skilled in the art from the following detailed description thereof, taken in conjunction with the drawings, in which:

FIG. 1 is a perspective view illustrating the general arrangement of the parts of a conventional stringed instrument, in this case, for purposes of illustration, a violin; and FIG. 2 is an enlarged view of the portion of the stringed instrument of FIG. 1, showing the improved bridge which is provided in accordance with the present invention and the method of use thereof on such a stringed instrument.

Briefly, in accordance with the invention, I provide methods and utilizing such bridge to improve or alter the tonal characteristics of a stringed musical instrument.

The musical instruments upon which the improved bridge may be employed are any of the conventional stringed musical instruments, including the violin, viola, violin-cello, base viol, which are played by bowing the strings. Such instruments generally comprise an elongate hollow tone-producing structure having vertical ribs forming front, rear and side surfaces and upper and lower resonating surfaces called, respectively, the table and the back. The table is formed of wood, the grain of which extends longitudinally of the elongate structure from the rear to the forward edge thereof. An elongate neck extends forwardly from the forward end of the tone-producing structure and includes a fingerboard portion. A plurality of transversely spaced tunable strings under tension are attached at their forward ends to the outer end of the neck and are attached at their other ends to the tone-producing structure toward the rear end thereof. An upstanding bridge member is mounted transversely on the table between the forward and the rear edges thereof, to maintain the tunable strings spaced above the fingerboard and the table.

The bridge utilized in accordance with the method of the present invention includes a pair of elongate feet formed integrally therewith, forming the contact between the bridge and the table. The feet extend at right angles to the bridge in directions substantially parallel to the grain of the wood from which the table is formed and contact the table along lines which are longer than the width of the feet.

By the method of the present invention, the tonal qualities of a stringed musical instrument are altered by employing the bridge member described above.

Turning now to the drawings, FIG. 1 depicts, for the purpose of illustrating the invention, a conventional violin having an upper table portions 10 and a back (not shown) 11, joined at their respective peripheries by "ribs" 12 to form an elongate hollow tone-producing structure. The upper table 10 is formed of wood, the grain of which extends longitudinally in the direction of the arrows A from the rear edge 13 to the forward edge 14 of the tone-producing structure. An elongate neck 15 extends forwardly from the forward edge 14 of the tone-producing structure and carries a fingerboard portion 16 along the top surface thereof. Four transversely spaced strings 17 are attached at their forward end to pegs 18 rotatable in the scroll 19. The rear ends of the strings 17 are attached to the tailpiece 20. A chin rest 21 is provided so that the instrument can be held between the performer's chin and shoulder. The bridge 22 rests upon the table 10 and spaces the strings 17 vertically above the fingerboard 16 and the table 10. As shown in FIG. 1, the feet **22*a* of the bridge 22 extend parallel to the bridge 22, i.e., across the grain of the table 10**.

As shown in FIG. 2, the improved bridge 30 of the present invention consists generally of a transverse bridge or arch portion 31 and elongate feet 32 which extend at right angles to the arch portion 31, i.e., parallel to the direction (indicated by the arrows B) of the grain of the wood from which the table 33 is formed.

The length (indicated by the arrows C) of the elongate feet 32 is such that they extend along the grain of the wood of the table a distance longer than the width (indicated by the arrows D) of the feet.

The bridge of the present invention is mounted upon a stringed instrument in the same manner and in the same position as prior art bridges and maintains the transverse spacing of the strings and the vertical spacing of the strings above the fingerboard and table of the instrument at distances equal to those maintained by prior art bridges. However, because the feet of the bridge of the present invention extend along, instead of across, the grain of the wood of which the table is formed, the tonal qualities of the instrument having the improved bridge of the present invention are markedly altered. In addition, the feet of the bridge prevent the bridge from tipping backward.

While certain of the tonal qualities such as richness, sweetness, balance and fullness, of the instrument are improved in accordance with the present invention, the improved bridge markedly affects those qualities which are associated with the ability of the instrument to be heard clearly in ensemble with other instruments, i.e., sonority, projection and bombastic quality. It is frequently these latter qualities which suffer most in less expensive instruments and when the improved bridge of the present invention is employed instead of prior art bridges, these latter qualities are improved, with lesser improvements in the richness, sweetness, balance and fullness qualities to achieve the sound of a much more expensive instrument.

Although it is not absolutely necessary, even further improvements in the tonal quality of the instrument can be achieved by also altering the position of the sound post which is contained within the hollow tone-producing structure. However, alteration of the position of the sound post should be attempted only by persons skilled in the instrument maker's art.

Having described my invention in such clear and concise terms as to enable those skilled in the art to understand and practice it, and having identified the presently preferred embodiment thereof, I claim:

1. In a method for constructing a stringed instrument of the violin family including the steps of forming an elongate hollow tone-producing structure having a curved upper table surface formed of wood, the grain of which extends longitudinally of the elongate structure and internal tone-affecting components forming an elongate neck extending forwardly of the tone-producing structure and including a fingerboard portion, a plurality of transversely spaced tunable strings under tension, attached at their forward ends to the outer end of said neck and at their other ends to the rear portion of said tone-producing structure, and mounting an upstanding bridge member mounted transversely on the table between the forward and rear edges thereof, to maintain said tunable strings spaced above said fingerboard and said table, said bridge having feet which contact said upper table surface which extends transversely across said table and perpendicular to the grain of the wood from which said table is formed the improvement whereby the tonal characteristics of said instrument are altered without structural modifications to said tone-producing structure, comprising the steps of:

(a) removing said bridge member having said transversely extending feet;

(b) increasing the sonority, projection and bombastic tonal qualities of said instrument without modification of said tone-producing structure, by fitting said instrument with a bridge which includes a pair of symmetrical elongate feet formed integrally therewith, forming the contact between the bridge and the table of said instrument, said feet having bottom surfaces extending at right angles to said bridge in directions substantially parallel to the grain of the wood from which said table is formed and shaped, contoured and dimensioned to continuously contact said curved table along lines which are longer than the width of said feet; and (c) maintaining said tone-producing structure and said internal components in their original condition.

* * * * *